US011168498B2

(12) United States Patent
Distefano et al.

(10) Patent No.: US 11,168,498 B2
(45) Date of Patent: Nov. 9, 2021

(54) ACTIVE PEDESTRIAN HOOD LATCH WITH DUAL FUNCTION CAM LEVER

(71) Applicant: Magna Closures Inc., Newmarket (CA)

(72) Inventors: John Distefano, Richmond Hill (CA); Csaba Szente, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 560 days.

(21) Appl. No.: 16/106,336

(22) Filed: Aug. 21, 2018

(65) Prior Publication Data

US 2019/0071900 A1 Mar. 7, 2019

Related U.S. Application Data

(60) Provisional application No. 62/553,681, filed on Sep. 1, 2017.

(51) Int. Cl.

| | |
|---|---|
| ***E05B 83/24*** | (2014.01) |
| ***E05B 77/08*** | (2014.01) |
| ***E05B 85/24*** | (2014.01) |
| ***E05B 85/26*** | (2014.01) |
| *E05B 79/20* | (2014.01) |

(52) U.S. Cl.

CPC ..... *E05B 83/24* (2013.01); *E05B 77/08* (2013.01); *E05B 85/243* (2013.01); *E05B 85/26* (2013.01); *E05B 79/20* (2013.01)

(58) Field of Classification Search

CPC ..... E05B 83/24; E05B 58/26; E05B 85/243; E05B 77/08; E05B 79/20

See application file for complete search history.

(56) References Cited

U.S. PATENT DOCUMENTS

| | | | | |
|---|---|---|---|---|
| 8,798,858 | B2 * | 8/2014 | Zysk | E05B 83/26 701/36 |
| 10,717,407 | B2 * | 7/2020 | Szente | E05B 51/023 |
| 2015/0145263 | A1 * | 5/2015 | Farris | E05B 85/26 292/195 |
| 2016/0076279 | A1 * | 3/2016 | Ilea | B60J 7/201 292/220 |

(Continued)

FOREIGN PATENT DOCUMENTS

| | | | |
|---|---|---|---|
| CN | 1672988 | A | 9/2005 |
| CN | 101746345 | A | 6/2010 |
| CN | 201777305 | U | 3/2011 |

(Continued)

*Primary Examiner* — Kristina R Fulton
*Assistant Examiner* — James Edward Ignaczewski
(74) *Attorney, Agent, or Firm* — Dickinson Wright PLLC

(57) ABSTRACT

A hood latch for a motor vehicle is provided. The hood latch includes a lift lever, a pawl, a ratchet, a control lever and an actuator. The control lever has a first cam surface and a second cam surface. The actuator is configured for actuation in response to a signal detected by a sensor. The actuator is actuatable in response to the signal to move into engagement with the control lever to bring the first cam surface into operable engagement with the pawl to move the pawl out of locked engagement with the ratchet, whereupon the second cam surface is brought into engagement with the lift lever to rotate the lift lever into engagement with a striker, fixed to a hood of the motor vehicle, to move the hood to a partially open state.

20 Claims, 12 Drawing Sheets

(56) References Cited

U.S. PATENT DOCUMENTS

| | | | | |
|---|---|---|---|---|
| 2018/0030763 | A1 | 2/2018 | Distefano et al. | |
| 2019/0338568 | A1 * | 11/2019 | Klein | E05B 79/20 |

FOREIGN PATENT DOCUMENTS

| | | | | | |
|---|---|---|---|---|---|
| CN | 105735788 | A | * | 7/2016 | E05B 77/08 |
| DE | 102007008700 | A1 | * | 8/2008 | E05B 85/26 |
| KR | 101609065 | B1 | | 4/2016 | |
| WO | 2017206987 | A1 | | 12/2017 | |

* cited by examiner

ACTIVE PEDESTRIAN HOOD LATCH WITH DUAL FUNCTION CAM LEVER

CROSS-REFERENCE TO RELATED APPLICATION

This application claims the benefit of U.S. Provisional Application Ser. No. 62/553,681, filed Sep. 1, 2017, which is incorporated herein by reference in its entirety.

FIELD

The present disclosure relates generally to latches for motor vehicle closure panels, and more particularly, to hood latch assemblies for motor vehicles.

BACKGROUND

This section provides background information related to hood latches and hood latch systems for motor vehicles which is not necessarily prior art to the inventive concepts associated with the present disclosure.

It is desired to best protect pedestrians against injury resulting from head on collisions with vehicles. When a car hits a pedestrian in a front end collision, the pedestrian can be thrown up and land on the front hood of the vehicle. In an effort to lessen the harshness of the impact of the pedestrian against the vehicle, and in particular to prevent the person's head from impacting the engine block or other hard object located directly beneath the front hood, it would be desirable to actively space the front hood from the engine block prior to the pedestrian impacting the front hood. In particular, when a front end collision is imminent, it would be desirable to move the front hood in a very short period of time (e.g., in milliseconds) from a fully closed first position, where the front hood is normally located immediately adjacent the engine block, to a second position where the front hood is actively and controllably moved further away from the engine block. The movement of the hood to the second position could provide the pedestrian's head and/or body with sufficient time and/or cushion space to more gradually decelerate as the pedestrian impacts the front hood, thereby potentially lessening the risk of severe injury to the pedestrian.

It is further desired to minimize the cost and complexity of motor vehicle safety systems and components thereof. Further yet, it is desired to be able to provide an ability to drive a vehicle away from an accident site without reasonable concern of the damaged hood opening while driving or otherwise transporting the vehicle. These problems and others associated with accidents causing damage to a hood are recognized, as would be readily understood by those skilled in the art of vehicle closure panels.

Desired is a hood latch and system therewith which provides solutions to these issues, as well as other issues understood by a person skilled in the art of vehicle hood panels.

SUMMARY

This section provides a general summary of the inventive solutions associated with the present disclosure. Accordingly, this section is not intended to be interpreted as a comprehensive and exhaustive listing of all features, aspects, objectives and/or advantages associated with the inventive solutions which are further described and illustrated in the following detailed description and the appended drawings.

It is an objective of the present disclosure to provide a motor vehicle hood latch and closure system therewith which addresses at least those issues discussed above.

It is a related objective of the present disclosure to further provide a motor vehicle hood latch and closure system therewith for use with any model of motor vehicle.

It is a further objective of the present disclosure to provide a motor vehicle hood latch and closure system therewith with an actuation system and release actuator having an ability to automatically sense an imminent front end impact and release a vehicle hood from a fully closed position to a partially open position without need of action from a driver of the vehicle and prior to a pedestrian impacting the vehicle hood.

It is a further objective of the present disclosure to provide a motor vehicle hood latch and closure system therewith with an ability to prevent the vehicle hood from inadvertently moving to a fully open position while transporting the vehicle after an accident.

In accordance with these and other objectives, a hood latch for a motor vehicle is provided. The hood latch has a latch assembly including a lift lever, at least one pawl, a ratchet, a control lever and an actuator. The control lever has a first cam surface and a second cam surface. The actuator is configured for actuation in response to a signal detected by a sensor. The actuator has a member that is actuatable in response to the signal to act on the control lever and bring the first cam surface into engagement with the at least one pawl and move the at least one pawl out of locked engagement with the ratchet, whereupon the second cam surface is brought into engagement with the lift lever to bring the lift lever into engagement with a striker, fixed to a hood of the motor vehicle, to move the hood from a fully closed state to a partially open state.

In accordance with another aspect of the disclosure, the at least one pawl can be provided having a generally planar body and a pawl pin extending outwardly from the generally planar body and the control lever can be provided having a recessed notch configured for receipt of the pawl pin to releasably maintain the control lever in its deployed position and prevent the lift lever from returning to its home position, thereby preventing the hood from being inadvertently closed.

In accordance with another aspect of the disclosure, a release lever can be configured to selectively pivot the at least one pawl and move the pawl pin out of the recessed notch to allow the control lever and release lever to return to their home positions and to allow the hood to be closed.

In accordance with another aspect of the disclosure, the release lever can be provided to be manually actuatable from within a cabin of the vehicle.

In accordance with another aspect of the disclosure, the actuator can be provided as a pyrotechnic actuator.

In accordance with another aspect of the disclosure, the member of the actuator can be provided as an extensible plunger and the control lever is provided to pivot about a pivot axis between its home position and deployed positions, and having a driven leg extending away from the pivot axis for engagement with the plunger and a drive leg extending away from the pivot axis for engagement with the lift lever, with the driven leg and the drive leg extending from opposite sides of the pivot axis away from one another.

In accordance with another aspect of the disclosure, the first cam surface and the second cam surface can be formed on opposite sides of the drive leg with a blocking surface extending along a free end of the drive leg, with the blocking surface being configured for abutment with the lift lever while the control lever is in its deployed position.

In accordance with another aspect of the disclosure, the recessed notch can be formed between the driven leg and the first cam surface.

In accordance with another aspect of the disclosure, the at least one pawl can include a primary pawl configured to releasably maintain the ratchet in its striker capture position and a secondary pawl configured to releasably maintain the ratchet in its striker partial release position, and the pawl pin can be formed to extend from the primary pawl.

In accordance with another aspect of the disclosure, a hood latch system for capturing and releasing a striker of a hood of a motor vehicle is provided. The hood latch system includes a latch assembly having a ratchet and at least one pawl, with the ratchet being moveable between a striker capture position whereat the ratchet retains the striker in a fully closed position, a striker partial release position whereat the ratchet retains the striker in a partially opened position, and a striker release position whereat the ratchet releases the striker. The at least one pawl is moveable between a primary lock position whereat the at least one pawl holds the ratchet in the striker capture position, a secondary lock position whereat the at least one pawl holds the ratchet in the striker partial release position, and an open position whereat the at least one pawl allows the ratchet to move to the striker release position. A lift lever is configured to pivot from a home position to a deployed position into forcible engagement with the striker. A control lever is configured to pivot from a home position to a deployed position, with the control lever having a first cam surface and a second cam surface. A controller and a sensor configured in electrical communication with one another, and an actuator is configured in electrical communication with the controller. The actuator is actuatable in response to a signal communicated from the sensor to the controller and from the controller to the actuator. The actuator has a member configured to act on the control lever upon actuation of the actuator to pivot the control lever from its home position to its deployed position. As the control lever is being pivoted to its deployed position, the first cam surface moves into engagement with the at least one pawl to pivot the at least one pawl out of locked engagement with the ratchet, whereupon the second cam surface is pivoted into engagement with the lift lever to pivot the lift lever from its home position to its deployed position and into forcible engagement with the striker to move and support the hood in a partially open state.

Further areas of applicability will become apparent from the description provided herein. The description and specific examples in this summary are only intended to illustrate certain non-limiting objects, aspects, and embodiments which are not intended to limit the scope of the present disclosure.

BRIEF DESCRIPTION OF THE DRAWINGS

Other objects, aspects, and advantages of the present disclosure will be readily appreciated, as the same becomes better understood by reference to the following detailed description when considered in connection with the accompanying drawings wherein.

Corresponding reference numerals are used to indicate corresponding components throughout the several views of the drawings unless otherwise indicated.

DETAILED DESCRIPTION OF EXAMPLE EMBODIMENTS

Figure 1:
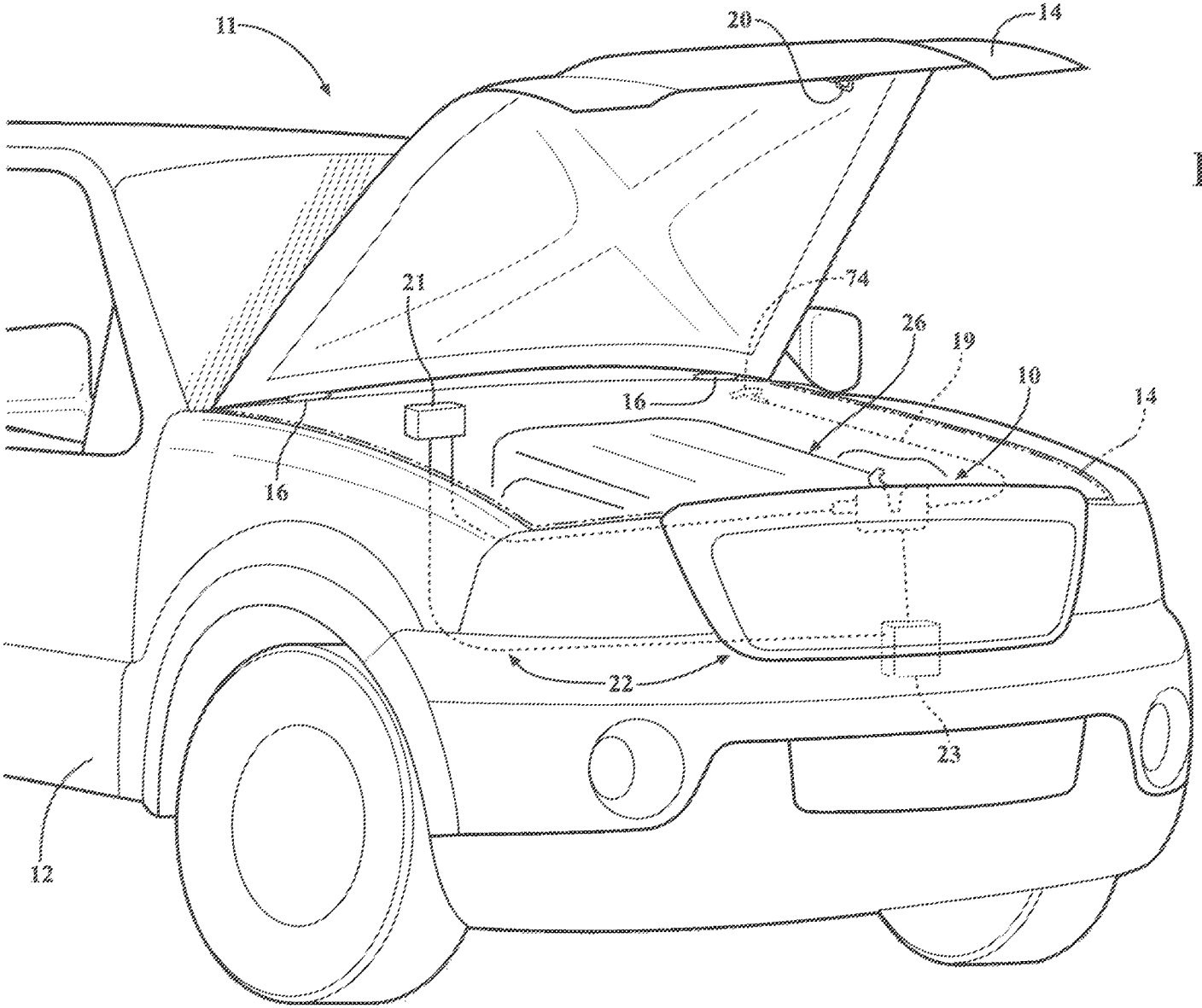
FIG. 1 is a partial perspective view of a vehicle including a hood latch assembly in accordance with one aspect of the disclosure.

In general, example embodiments of a vehicle hood latch constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Referring to FIG. 1, in accordance with an illustrative non-limiting embodiment, shown is a vehicle 11 with a vehicle body 12 having one or more closure panels, shown as a front vehicle hood 14 connected to the vehicle body 12 via one or more panel operation components, for example, such as, but not limited to, a hinge 16 and a hood latch assembly, referred to hereafter as latch 10 (e.g. for retaining the closure panel 14 in a closed position once closed or for retaining the closure panel 14 in an open position once opened). The hood 14 has a mating latch component 20 (e.g. striker) fixedly mounted thereon for selective coupling with the latch 10 mounted on the vehicle body 12. The hood 14 can be moved between a fully closed position (shown in phantom outline), a partially opened position (released from fully closed position but retain by latch 10 against being fully opened), and an open panel position (shown in solid outline) in response to selective actuation of latch 10, such as via a communication member 19, e.g. cable and/or electrical member, configured in operable communication with a hood latch release member/mechanism 74 in an internal passenger cabin of the vehicle 11. Also provided is a hood latch system including the latch 10 and an actuation system 22 for automatically sensing, signaling and actuating the intended operation of the latch 10 in response to an imminent impact, such as a front end collision event, e.g. collision with a pedestrian, as further discussed below. In this manner, the hood latch system including the actuation system 22 and latch 10 can communicate to forcefully provide, upon sensing, signaling and deployment, some form of force assisted open operation (e.g. partially open) of the hood 14, thereby reducing the potential for harm to the pedestrian landing on the hood 14.

Movement of the hood 14 (e.g. between the open and closed panel positions) can be electronically and/or manually operated. As such, it is recognized that movement of the hood 14 can be manual or power assisted during operation of the hood 14 at, for example: between fully closed (e.g. fully locked or fully latched) and fully open (e.g. fully unlocked or fully unlatched) positions; and/or between fully closed and partially open (e.g. partially unlocked or partially unlatched) positions; and/or between partially open and fully open positions. It is recognized that the partially open position of the hood 14 can also include a secondary lock/latch member (e.g. hood 14 has a primary lock configuration/position at fully closed and a secondary lock configuration/position at partially open), discussed further below.

Actuation system 22 includes a vehicle controller 21 (e.g. vehicle computer, such as an electronic control unit or a Body Control Module (BCM).) configured in electrical communication with at least one or a plurality of sensors 23 (e.g. an accelerometer) located on the vehicle body 12 and/or on the hood 14 (e.g. at the front of the vehicle 11 such as in the vehicle front bumper) and with latch 10. Upon sensor 23 detecting an imminent frontal crash/impact, sensor 23 communicates with vehicle controller 21, whereupon vehicle controller 21 sends a trigger signal to actuate a release actuator 24 (FIGS. 2-9) of latch 10 to automatically cause the latch 10 to move to a partially open position (FIG. 8), thereby causing the hood 14, fixed to striker 20, to be moved to a partially open position within milliseconds of the signal being received and sent by sensor 23 to controller 21, wherein the hood 14 is suddenly moved away from an underlying engine 26, thereby provided an increased space between the hood 14 and engine 26. Accordingly, if a pedestrian subsequently impacts the hood 14 after actuation of actuation system 22, a cushion effect of the slightly raised hood 14 is provided, which lessens the impact force to the pedestrian, and can ultimately reduce the potential of the pedestrian directly impacting the engine 26, thereby reducing the potential for harm to the pedestrian.

Figure 2:
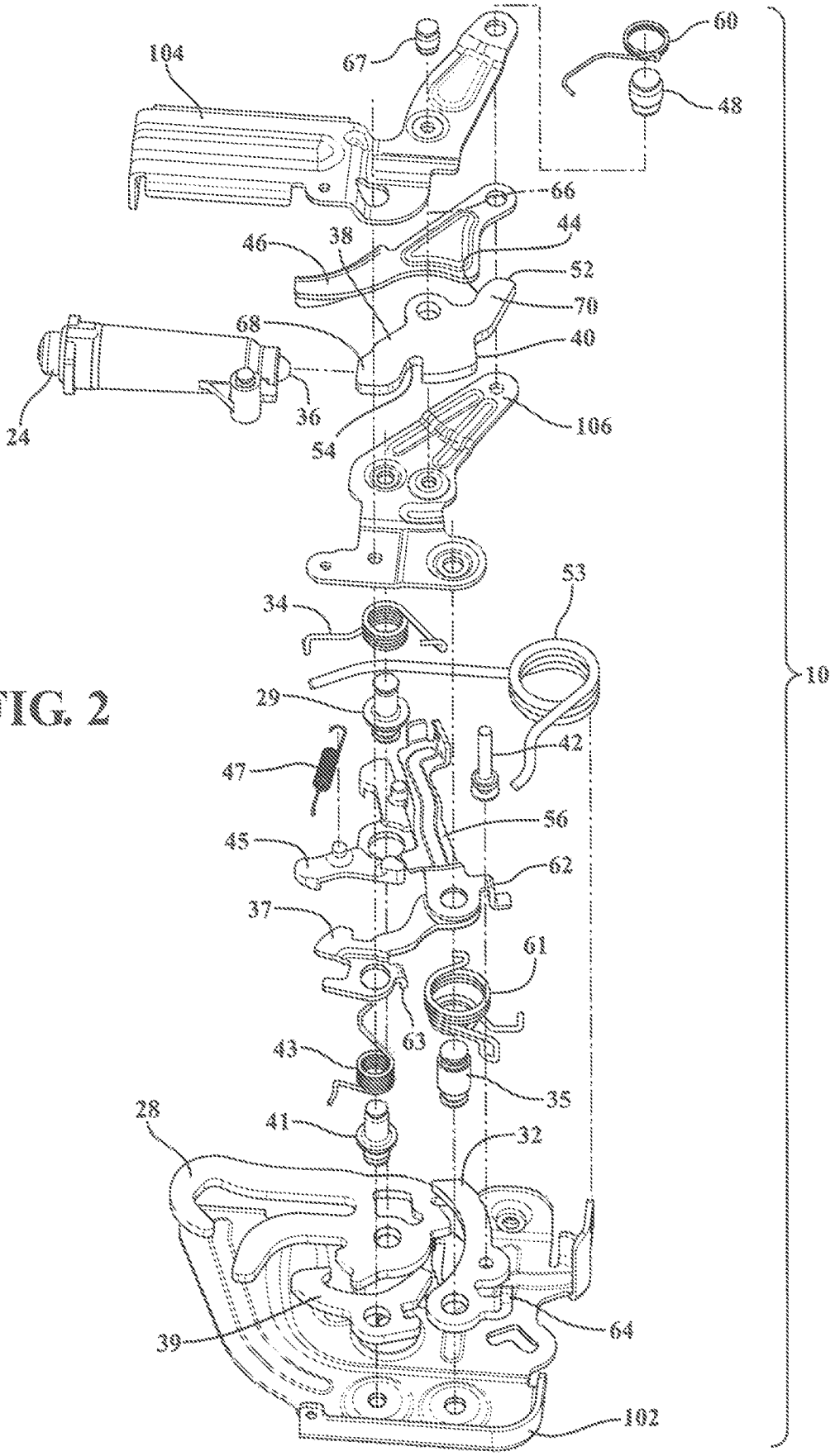
FIG. 2 is an exploded view of a latch assembly of the vehicle of FIG. 1 in accordance with an aspect of the disclosure.
Figure 3:
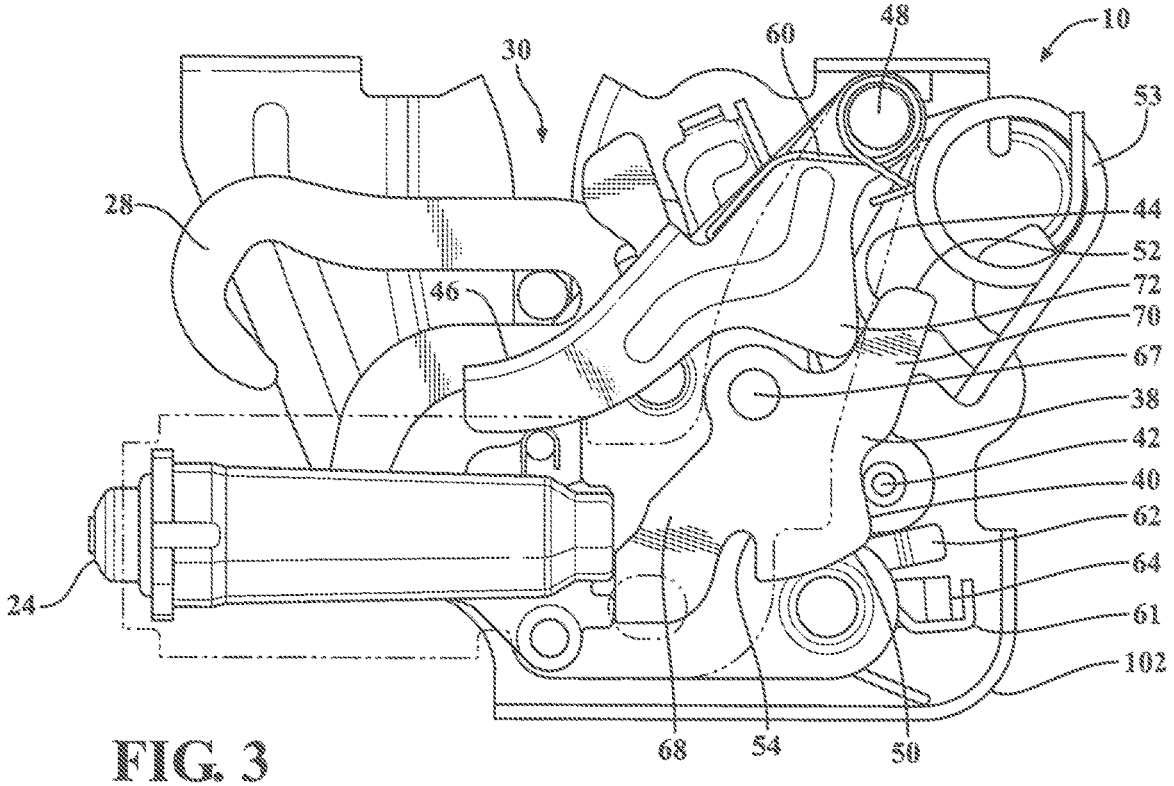
FIGS. 3 and 3A are opposite side views of the latch assembly of FIG. 2 shown in a fully closed and fully latched state.
Figure 3A:
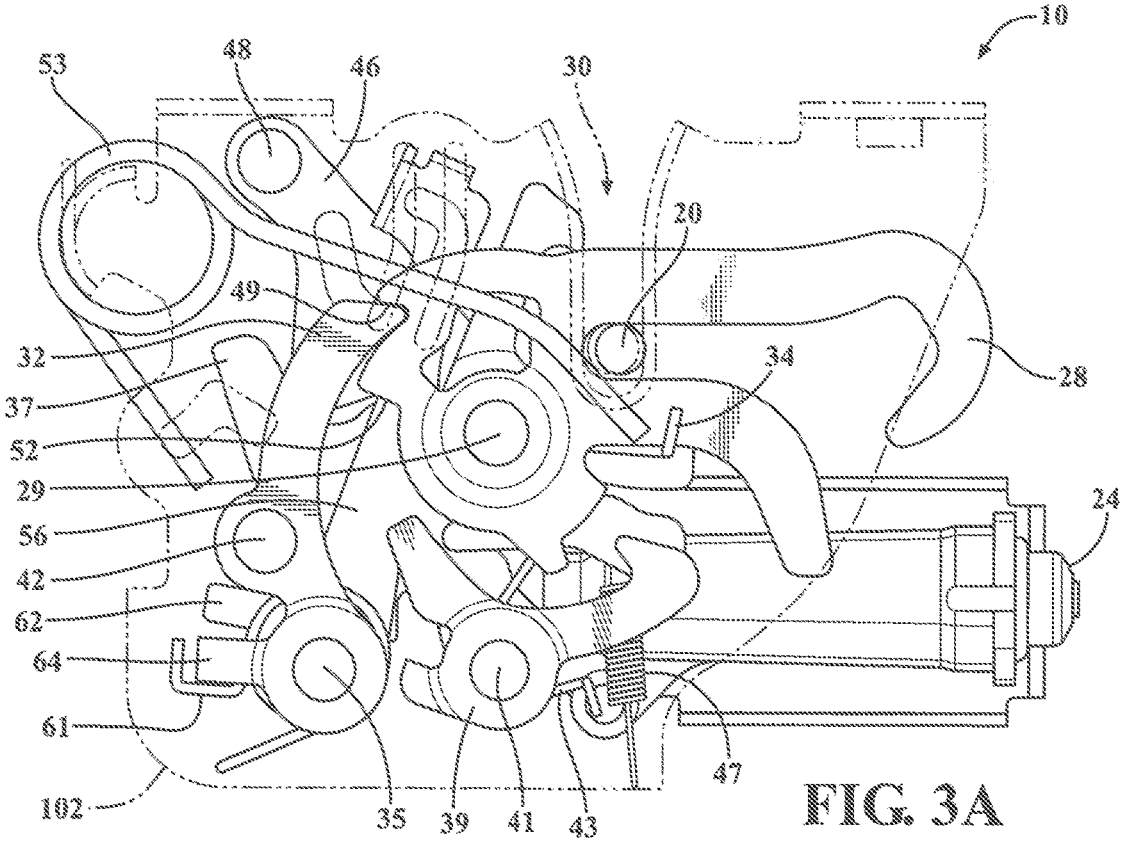
Figure 4:
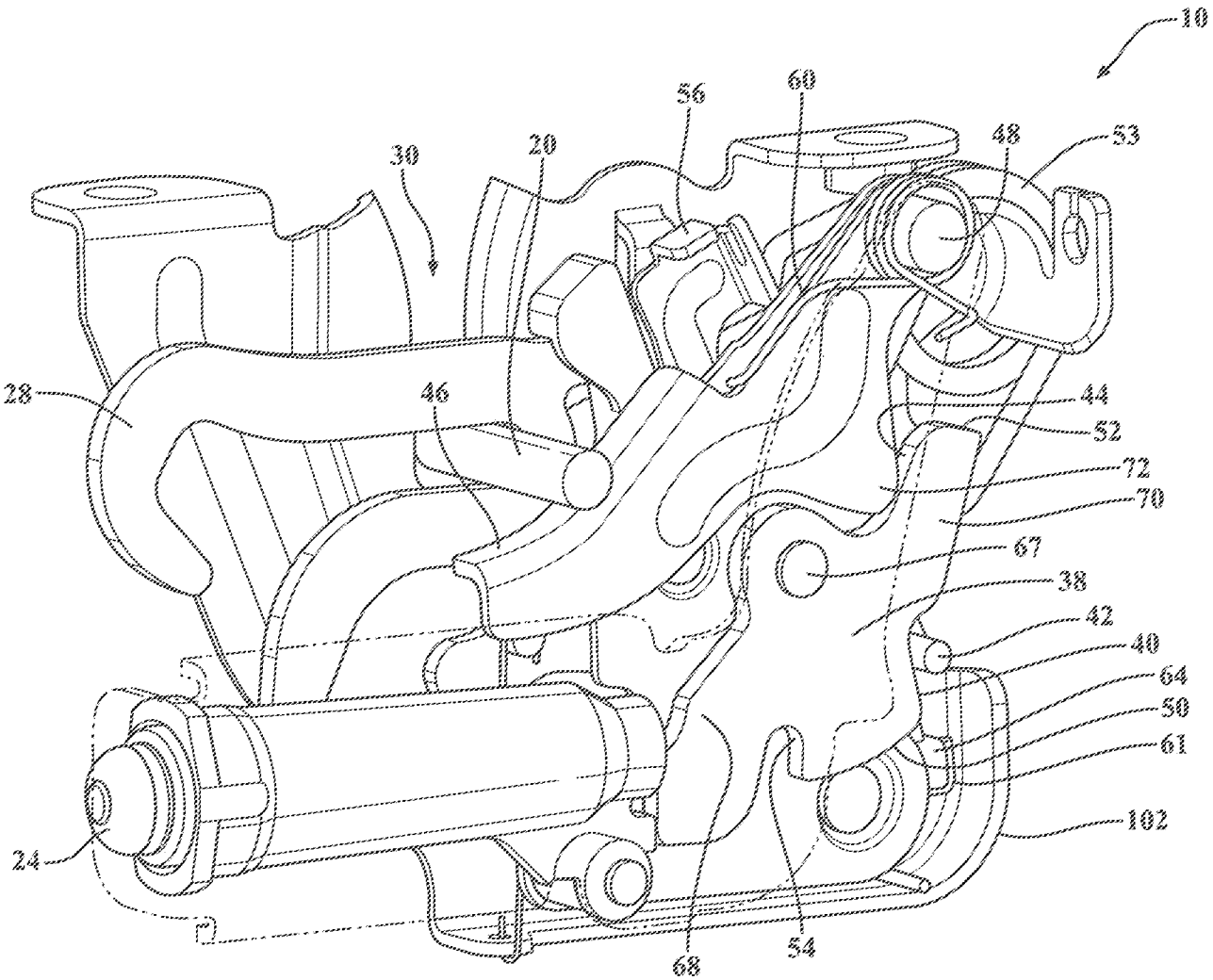
FIGS. 4 and 4A are opposite perspective side views of the latch assembly of FIG. 2 shown in a fully closed and fully latched state.
Figure 4A:
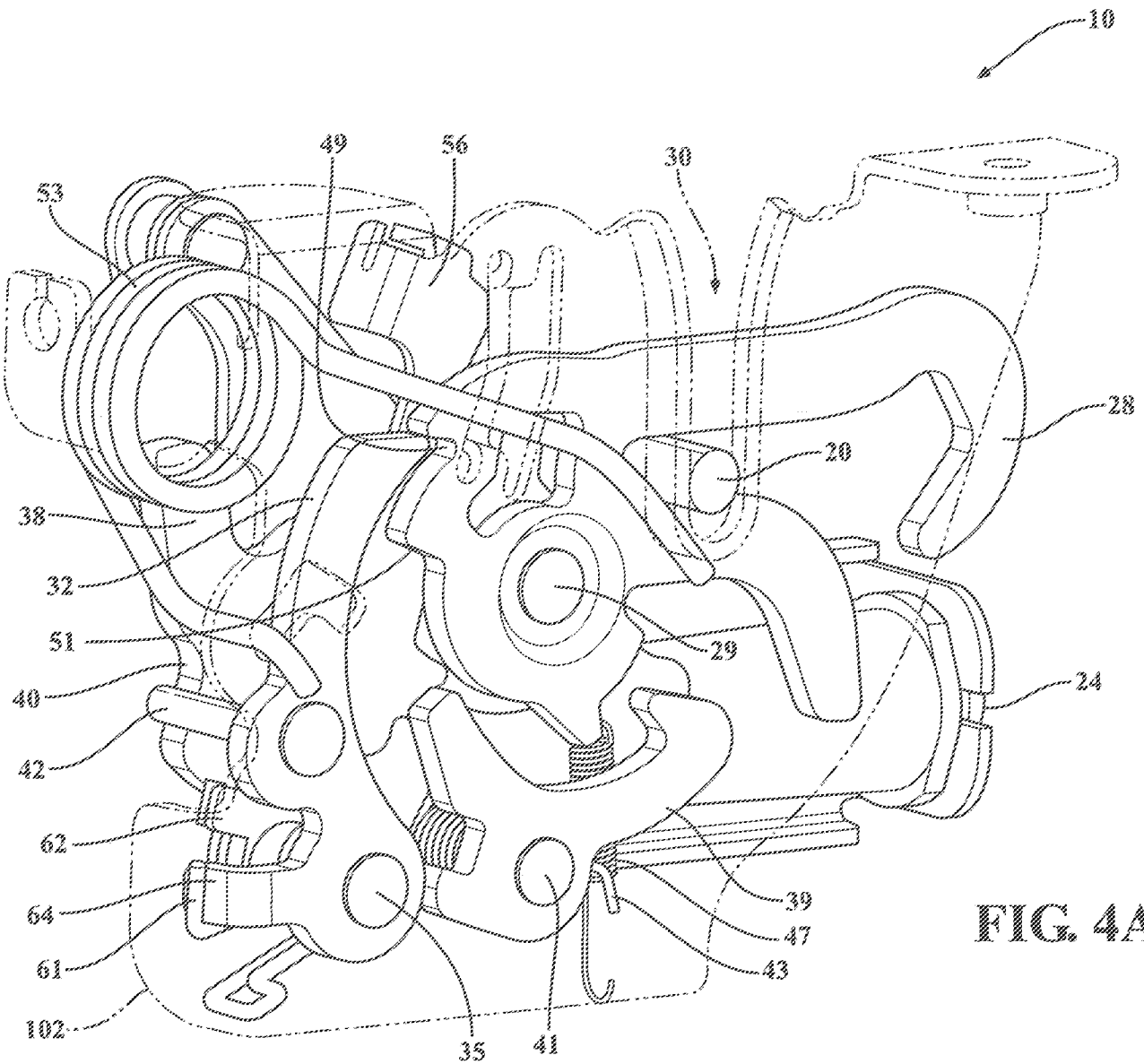
Figure 5:
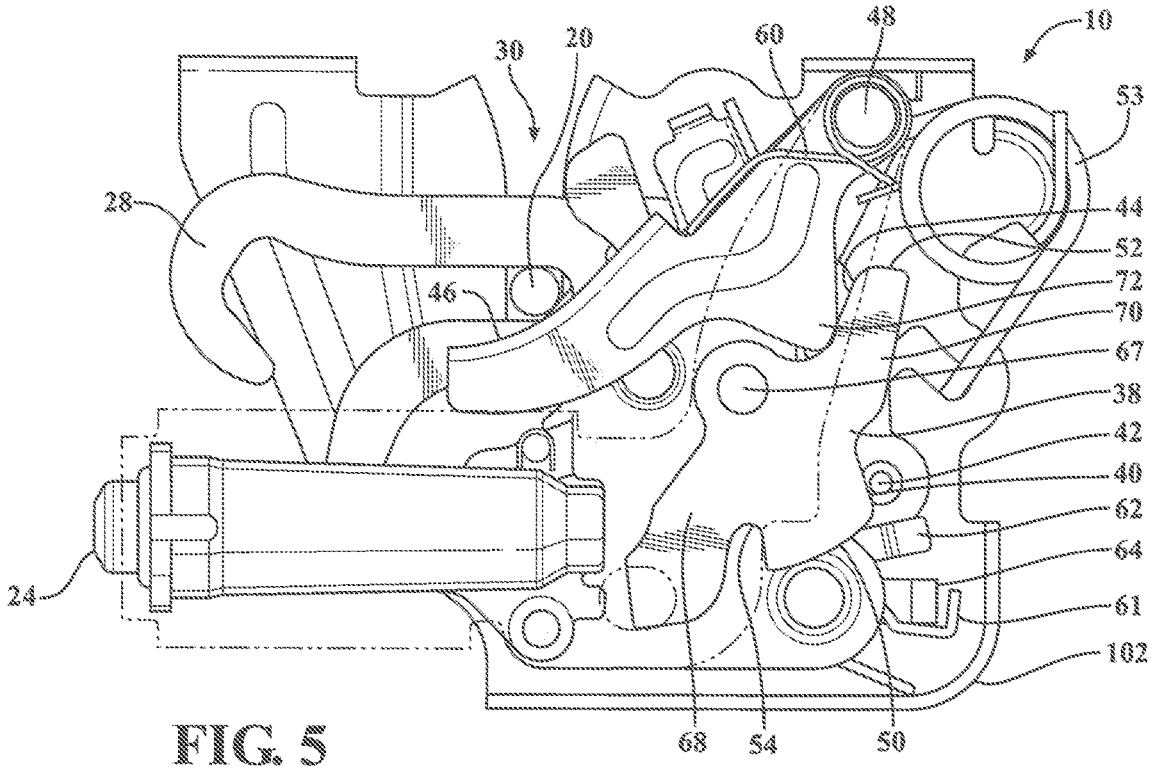
FIGS. 5 and 5A are similar views of the latch assembly as shown in FIGS. 4 and 4A, showing the latch assembly in an initial state of release via actuation of an actuator in response to a detected imminent front end impact, with a primary pawl shown pivoted out of locking engagement with a ratchet of the latch assembly.
Figure 5A:
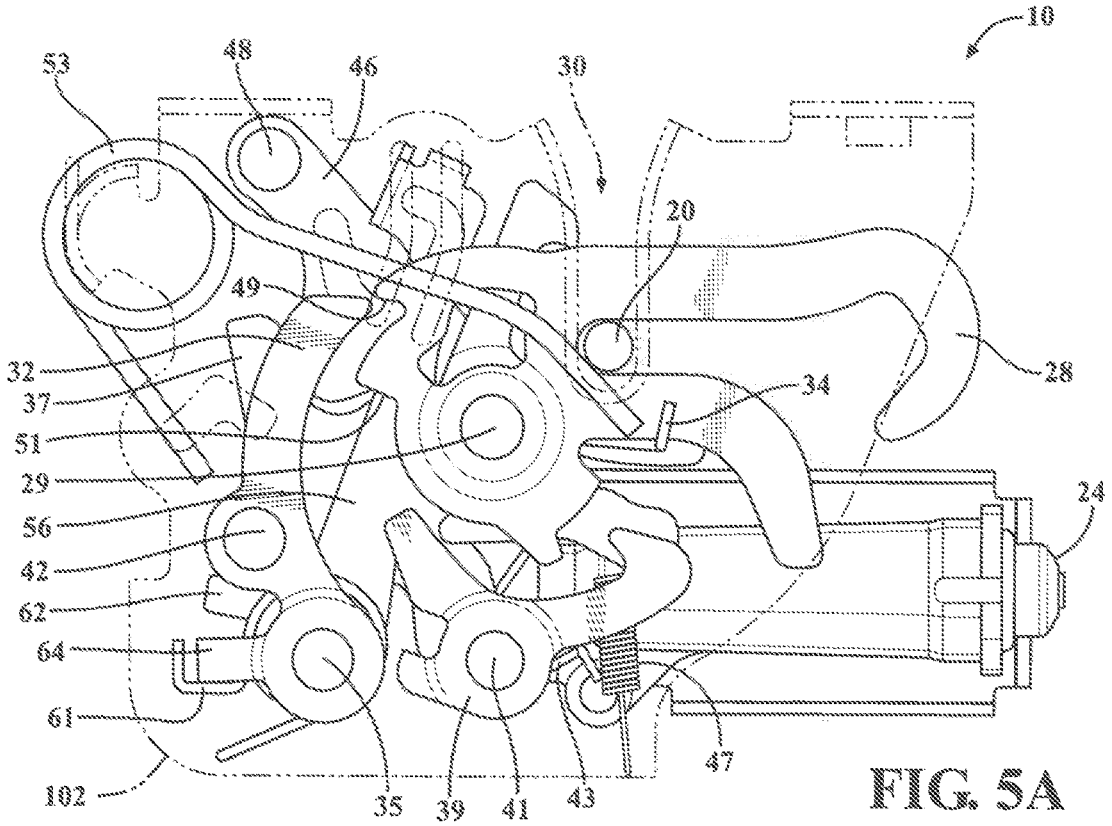

FIG. 2 illustrates, by way of example and without limitation, an exploded perspective of latch 10 configured in accordance with one non-limiting aspect of the disclosure, as a double pull, double pawl latch 10, such as discussed in co-owned U.S. patent application Ser. No. 15/658,499, filed on Jul. 25, 2017, published Feb. 1, 2018 under U.S. Patent Pub. No. 2018/0030763, the entire disclosure of which is incorporated herein by way of reference. Latch 10, in accordance with the non-limiting embodiment of FIGS. 2-9, generally includes a housing 102, a cover/support plate 104 and a mount plate 106. Latch 10 also includes a latching mechanism including a variety of internal latch components, such as a ratchet 28 pivotably coupled to housing 102 via a ratchet pivot, shown as a ratchet pivot rivet or pin 29, wherein the ratchet 28 is biased by a ratchet spring, shown as a torsion spring 34, by way of example and without limitation, toward a striker release position (ratchet 28 is positioned to release striker 20 in striker release position). A pawl assembly is provided and includes a primary pawl 32 pivotably coupled to housing 102 via a primary pawl pivot, shown as a primary pawl pivot rivet or pin 35, wherein the primary pawl 32 and a release lever 56 are biased by a primary pawl and release lever spring, shown as a torsion spring 61, by way of example and without limitation, with the primary pawl 32 being biased toward a closed, ratchet checking or restraining position. A primary pawl extension 37 and a secondary pawl 39 are mechanically interconnected (via a lug and slot configuration) for pivotable movement on housing 102 about a secondary pivot rivet or pin 41 and are biased by a secondary pawl spring 43. A snow load lever 45 is pivotably mounted to housing 102 for pivotable movement about ratchet pivot pin 29 and is biased via a snow load spring 47. A hood latch pop spring 53 is provided to bias against the striker 20 upon fully unlatching the ratchet to its striker release position to allow hood 14 to be lifted to a fully open, also referred to as fully raised position. Finally, a lift lever 46 is mounted for pivotable movement about a lift lever rivet or pivot pin 48 to cover plate 104 and is biased via a lift lever spring 60 toward a home, non-lifting, non-deployed position (FIGS. 3-5). While the pawl assembly described hereinabove was made with reference to a double pawl arrangement having a primary pawl 32 and a secondary pawl 39, the pawl assembly may also be provided with a single pawl, or other arrangement which provides for a locking/unlocking of the ratchet 28 at desired position(s) to control the release and/or capture of the striker 20.

The movement of the latch 10 being partially unlatched in response to a detected imminent front end impact via automatic actuation (without need of assistance from any passenger) of the release actuator 24 is now discussed with reference to an unlatching sequence illustrated in FIGS. 3-9.

Figure 3B:
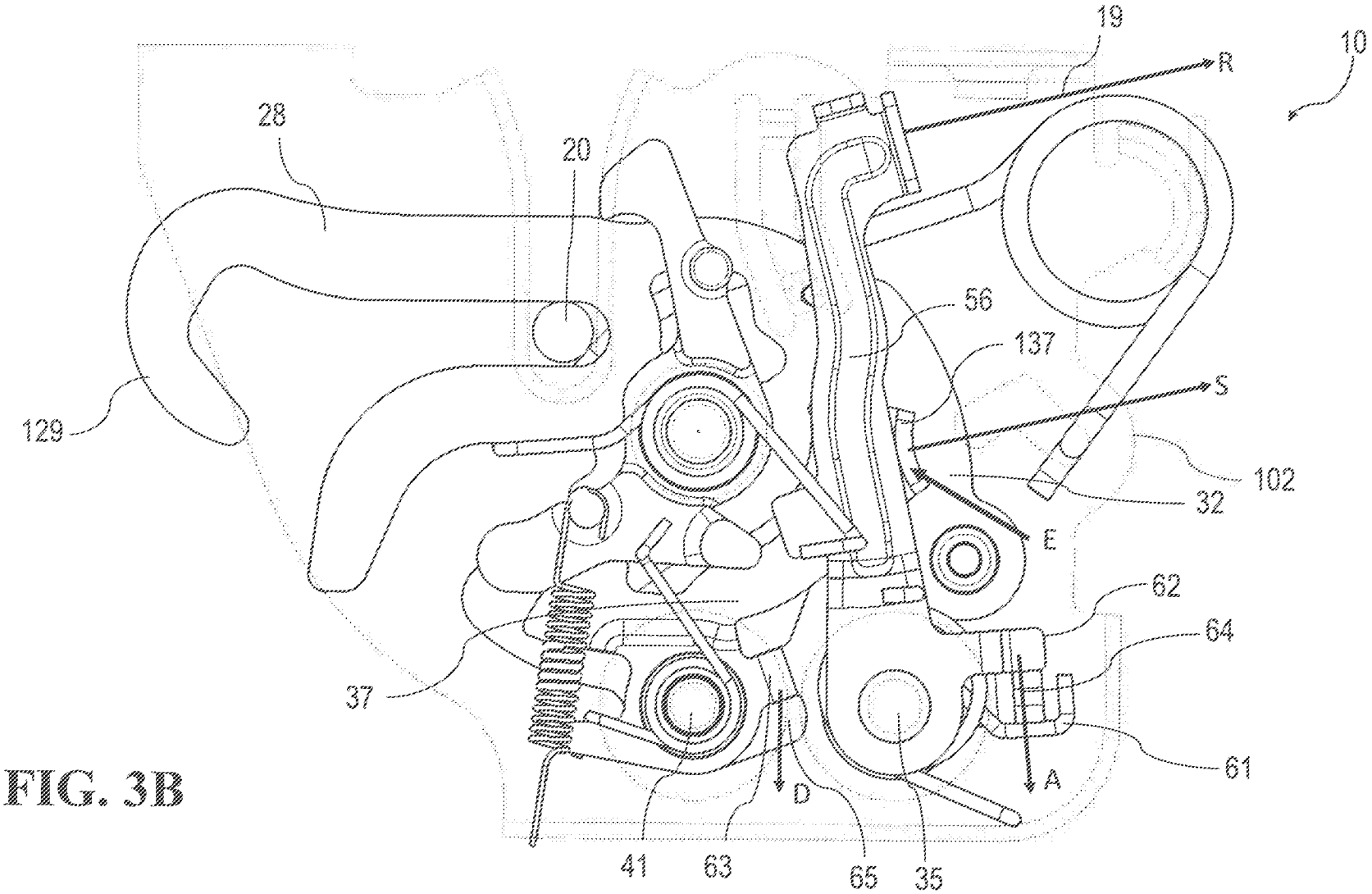
FIGS. 3B and 3C are opposite side views of the latch assembly of FIG. 2 shown in a fully closed and fully latched state with various components removed for showing the release lever interfaces with a primary pawl and a secondary pawl.
Figure 3C:
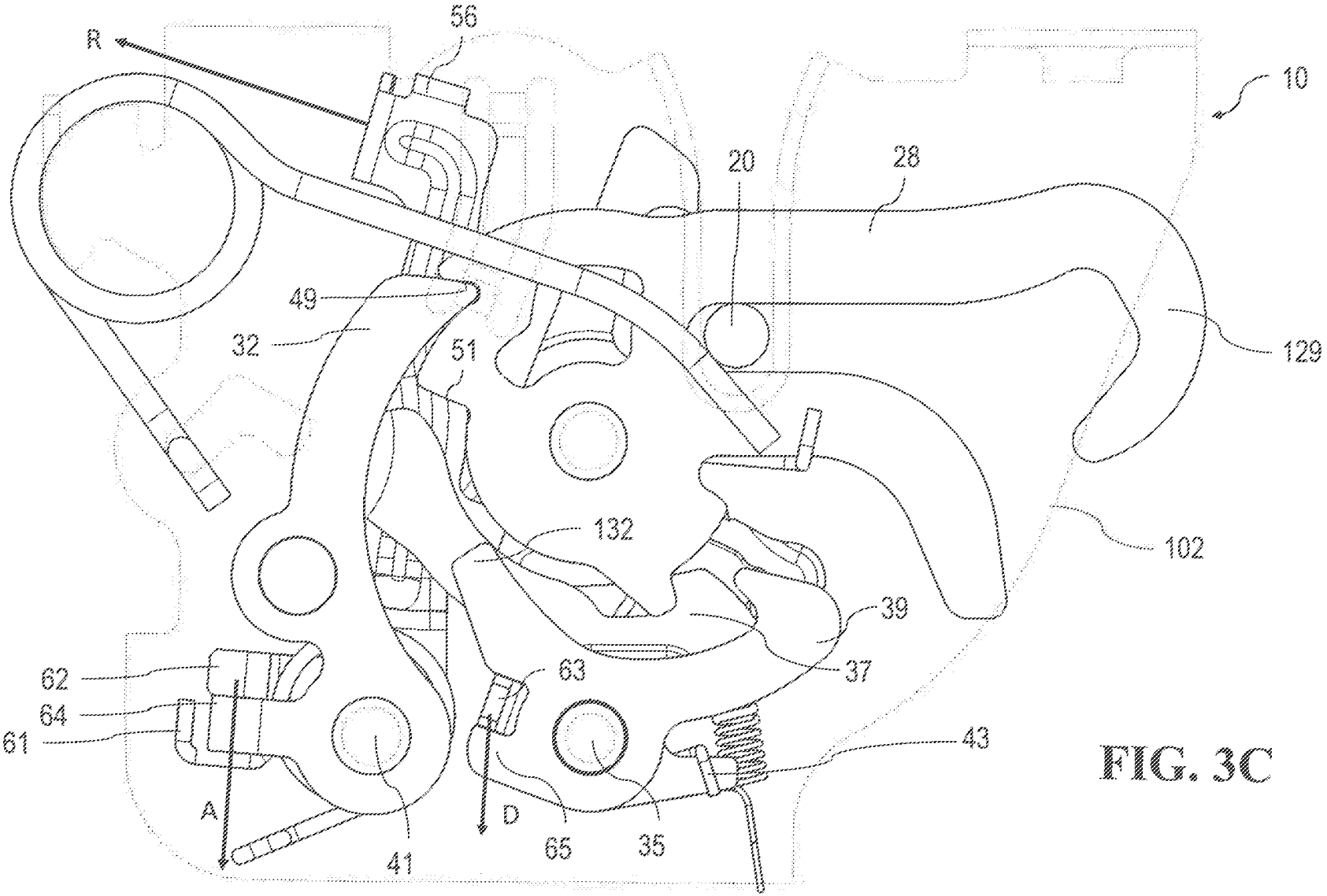

In FIGS. 3, 3A, 4 and 4A, the latch 10 is shown in a fully locked state, with the release actuator 24 shown in a deactivated state. As such, a ratchet 28 of the latch is maintained in a closed, striker capture position, also referred to as fully locked state, to fully capture the striker 20 downwardly in the bottom of a fishmouth 30 of the latch 10. While in the fully locked state, a nose of the primary pawl 32 is maintained in a closed, ratchet checking position in locked engagement with a primary locking notch or surface 49 of the ratchet 28 via bias imparted by the primary pawl spring 61, thereby overcoming the bias of a ratchet release spring 34, and thus, preventing movement of the ratchet 28 toward an open, striker release position under the bias of the ratchet release spring 34, as is known by those skilled in the art. Now referring to FIGS. 3B, and 3C, in order to normally release the latch 10 from its fully lock state, for example in order to be able to raise the hood 14 to gain access to the engine 26, a double-pull release arrangement is provided whereby the release lever 56 is pivoted via release member 19 as indicated by arrow R (see FIG. 3), an arm 62, extending laterally outwardly from a generally planar body of release lever 56, is driven in the direction of arrow A and brought into engagement with a tab 64 extending outwardly from the generally planar body of primary pawl 32 and causes the primary pawl 32 to be rotated clockwise, such that the nose of the primary pawl 32 is moved out of locked engagement with the primary locking notch or surface 49 of the ratchet 28 against the bias imparted by the primary pawl spring 61. As a result of the disengagement of the primary pawl 32 from the ratchet 28, the ratchet 28 is allowed to rotate until the leg 132 of the secondary pawl 39 is brought into locked engagement with the second locking notch or surface 51 of the ratchet 28 via bias imparted by the secondary pawl spring 43 to maintain the ratchet 28 is its striker partial release position. To disengage the secondary pawl 39, the release lever 56 is pivoted a second time via release member 19 as indicated by arrow R (see FIG. 3), its movement imparting a movement of the primary pawl extension 37 at interface E between the primary pawl extension 37 and the release lever 56 through an upstanding lug 137 provided on primary pawl extension 37, a secondary arm 63, extending laterally outwardly from a generally planar body of primary pawl extension 37, is driven in the direction of arrow D and brought into engagement with a secondary tab 65 extending outwardly from the generally planar body of secondary pawl 39 and causes the secondary pawl 39 to be rotated counterclockwise (in FIG. 3C), such that the nose 132 of the secondary pawl 39 is moved out of locked engagement with the primary locking notch or surface 51 of the ratchet 28 against the bias imparted by the secondary pawl spring 43, such that after disengagement of the secondary pawl 39, the ratchet 28 is allowed to rotate to its striker release position.

In FIG. 5, the sensor 23 of the actuation system 22 has detected an imminent front end collision, and thus, the release actuator 24 has been activated. A moveable member 36 of the release actuator 24, shown as an extensible plunger 36 of the release actuator 24, by way of example and without limitation, has begun to extend suddenly in response to the activation, wherein a free end of the plunger 36 acts on and pushes under sufficient force on a dual function control disk, also referred to as cam lever or control lever 38. It is to be recognized that although the moveable member 36 is shown as a linearly extensible plunger 36, a non-linearly moveable member 36 is contemplated herein, such as a rotatable member, by way of example and without limitation. Control lever has a pivot axis 66 defined by control pin 67 about which the control lever 38 pivots between a home position and a deployed position. Control lever 38 has a driven leg 68 extending away from the pivot axis 66 for engagement with the free end of the plunger 36 and a drive leg 70 extending away from the pivot axis 66 for engagement with the lift lever 46, wherein the driven leg 68 and the drive leg 70 extend from opposite sides of the pivot axis 66 and away from one another. Upon actuation of actuator 24, forcible engagement of plunger 36 on driven leg 68 causes the control lever 38 to rotate in a counterclockwise direction, wherein a first cam surface 40 of the control lever 38 is brought into engagement with, and moves a pawl pin 42, which is fixed directly to the primary pawl 32 and extends outwardly from a generally planar body of primary pawl 32 in generally transverse relation therefrom, in a counterclockwise direction. As such, with the pawl pin 42 being fixed to the primary pawl 32, the primary pawl 32 is pivotably moved in a clockwise direction against the bias of the primary pawl spring 61 and out of locked engagement from the ratchet 28.

Then, upon releasing the primary pawl 32 from locked engagement with the ratchet 28, as the control lever 38 continues to rotate counterclockwise, a second cam surface 44 on the drive of the control lever 38 is brought into engagement with an end of a nose-shaped protuberance 72 of the lift lever 46 and begins to move lift lever 46 from a non-deployed, home position, in a clockwise direction about the lift lever pin or rivet 48 against the bias imparted by lift lever spring 60. The first cam surface 40 and the second cam surface 44 are an opposite sides of the drive leg 70 with a blocking surface 52, discussed further below, extending along a free end of the drive leg 70.

Figure 6:
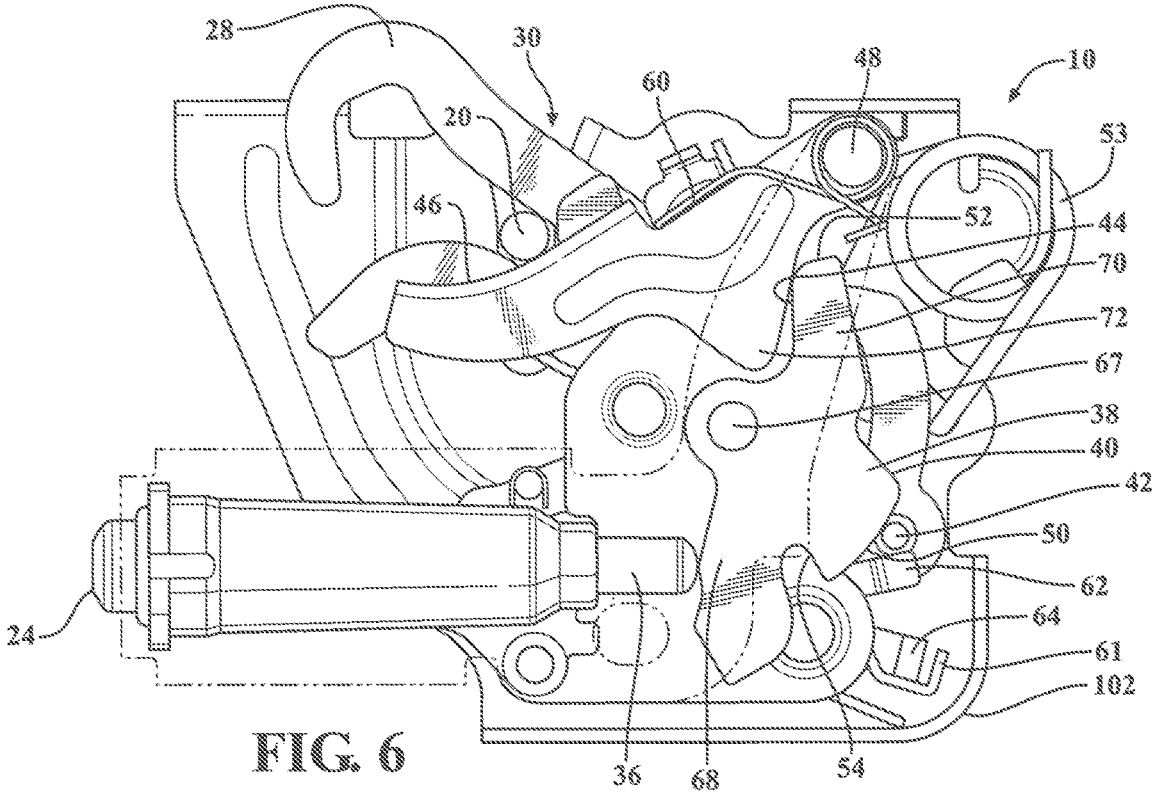
FIGS. 6 and 6A are similar views of the latch assembly as shown in FIGS. 5 and 5A, showing a lift lever initiating movement of a striker, fixed to a hood of the vehicle, upwardly within a fishmouth of the latch assembly in response to continued actuation of the actuator.
Figure 6A:
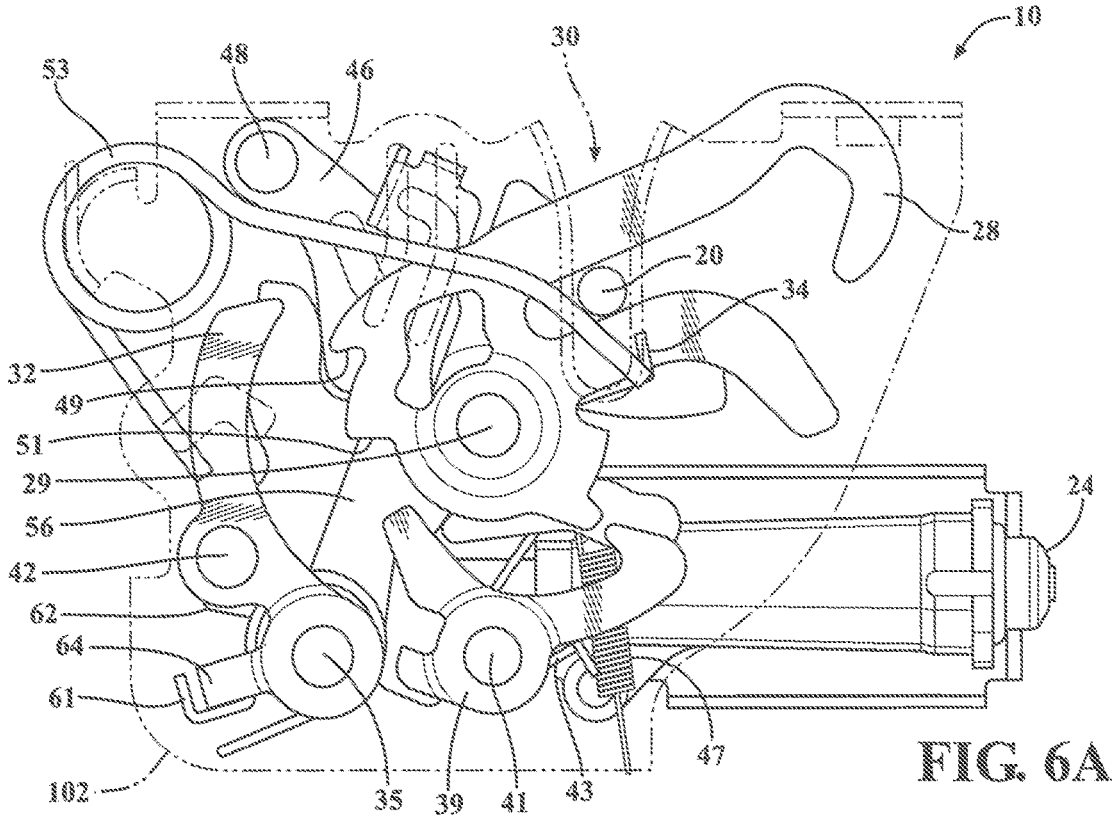

As shown in FIG. 6, as the control lever 38 continues to rotate counterclockwise, and the ratchet 28 continues to rotate under the bias of ratchet release spring 34, the first cam surface 40 of control lever 38 is moved out of contact with the pawl pin 42, whereupon a bearing surface, also referred to as barrier surface 50 of control lever 38, extending generally transversely from first cam surface 40, is brought into engagement with the pawl pin 42 to prevent the primary pawl 32 from rotating counterclockwise under the bias of primary pawl spring 61 back into contact with the ratchet 28. Accordingly, the primary pawl 32 is maintained out of engagement with ratchet 28. Further yet, the second cam surface 44 of control lever 38 continues to push on protuberance 72 the lift lever 46 to cause continued upward movement of the striker 20 outwardly from the fishmouth 30.

Figure 7:
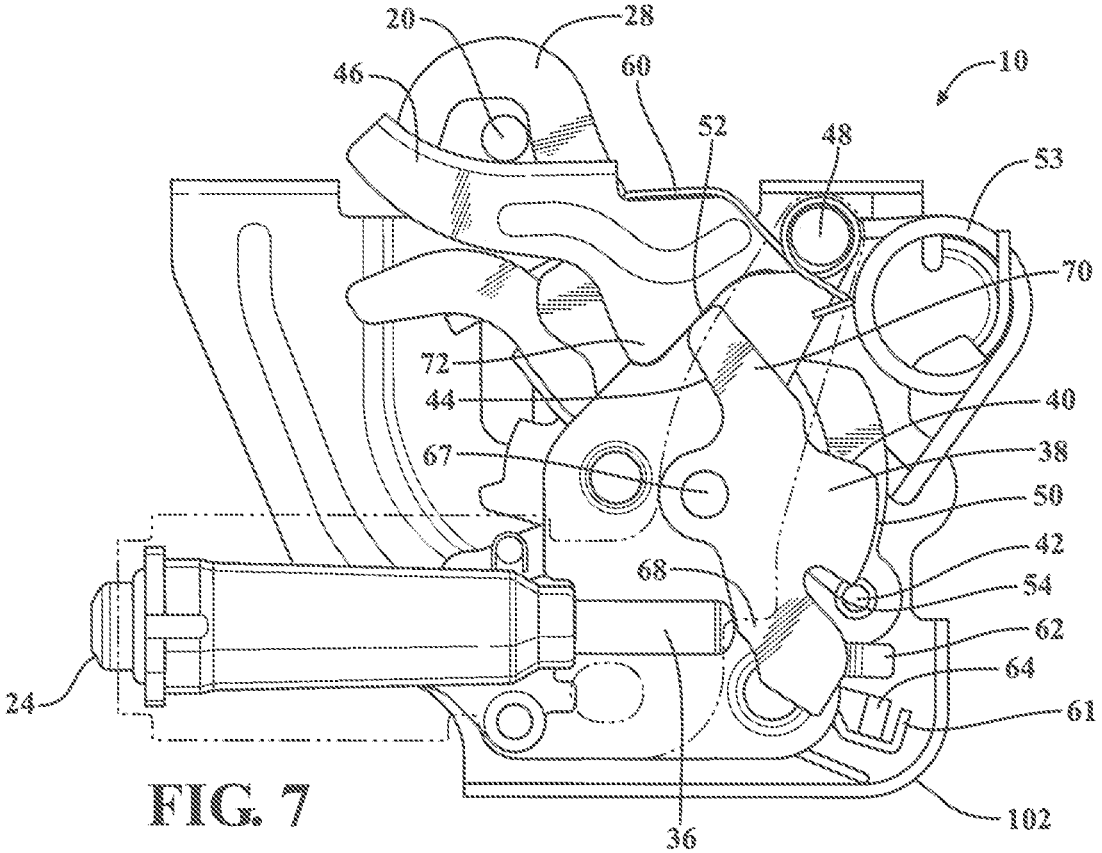
FIGS. 7 and 7A are similar views of the latch assembly as shown in FIGS. 6 and 6A, showing the lift lever continuing movement of the striker upwardly within the fishmouth of the latch assembly in response to continued actuation of the actuator.
Figure 7A:
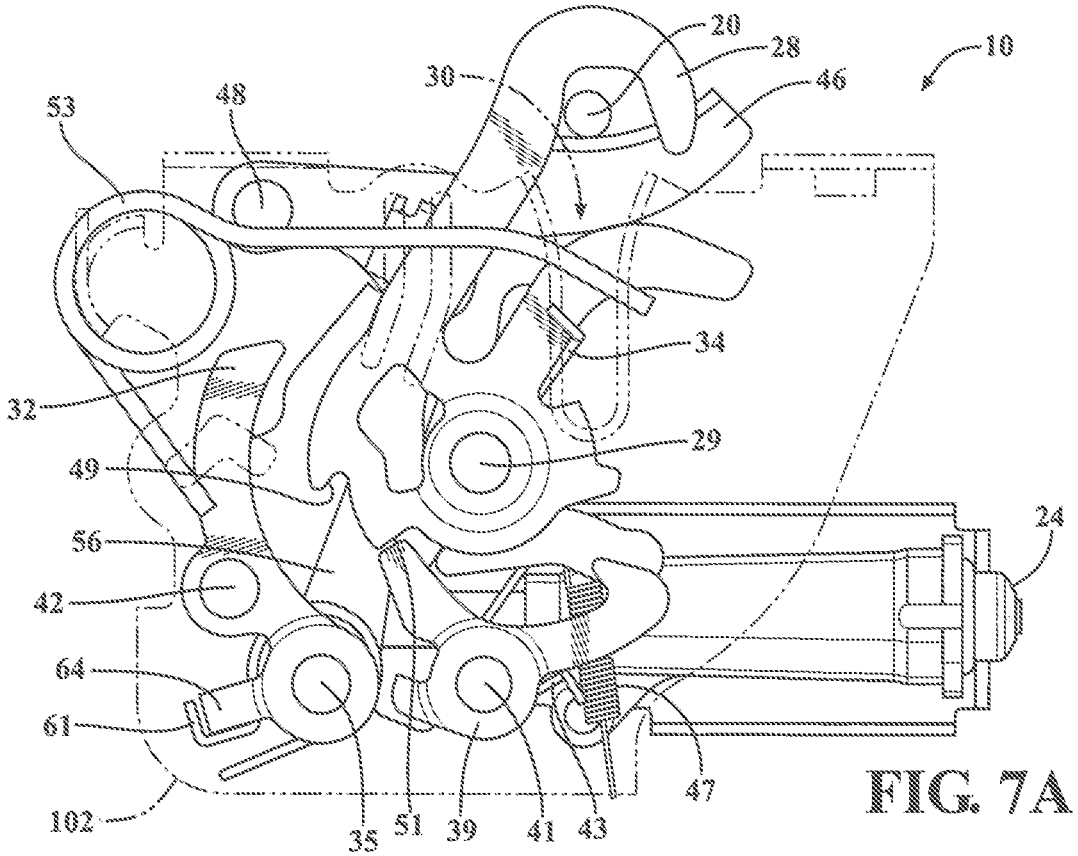

In FIG. 7, as the control lever 38 is moved further in the counterclockwise direction under the driving force of plunger 36, blocking surface 52, extending generally transversely from second cam surface 44 between the second cam surface 44 and the first cam surface 40, is brought into engagement with the lift lever 46 to releaseably maintain the lift lever 46 in a release position, wherein the striker 20 is maintained in a partially unlatched, raised position. Accordingly, the hood 14, which is fixed to the striker 20, is also maintained in a raised position away from the underlying engine 26.

Figure 8:
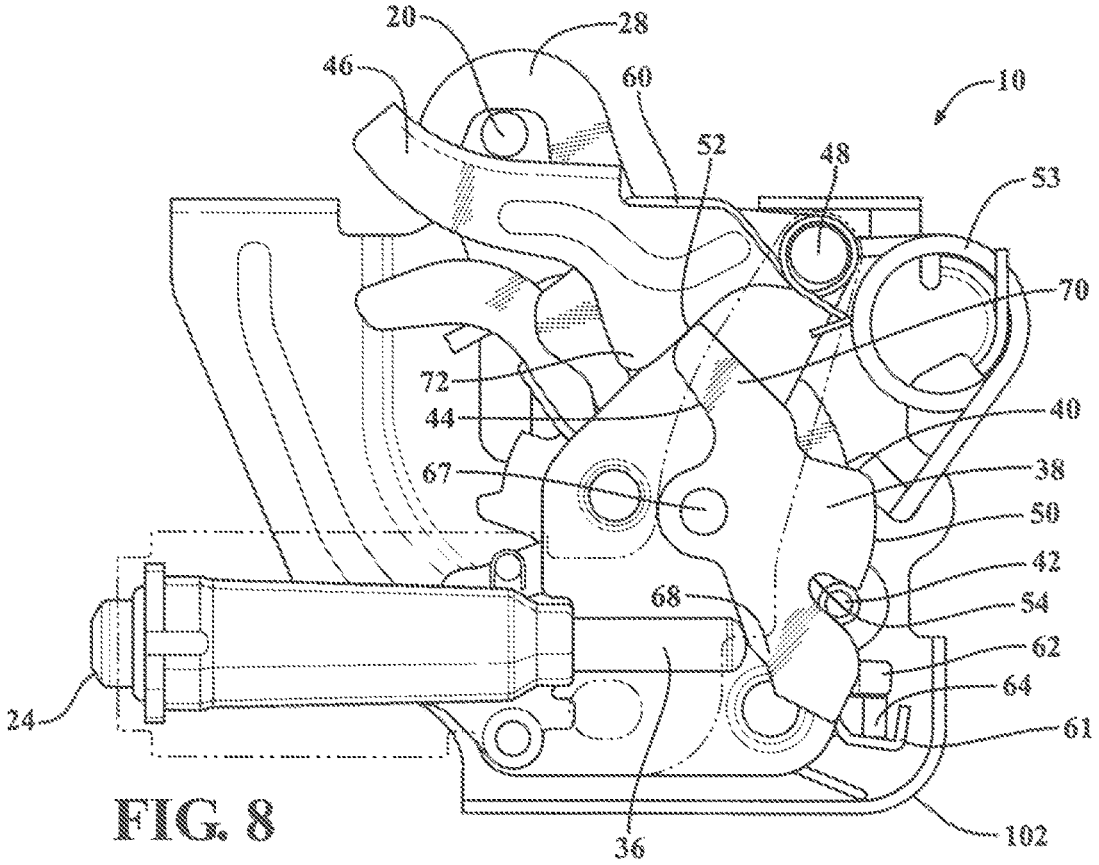
FIGS. 8 and 8A are similar views of the latch assembly as shown in FIGS. 7 and 7A, showing the lift lever fully deployed and releasably maintained in a deployed position with the striker being releasably maintained in a partially upwardly position within a fishmouth of the latch assembly in response to continued actuation of the actuator.
Figure 8A:
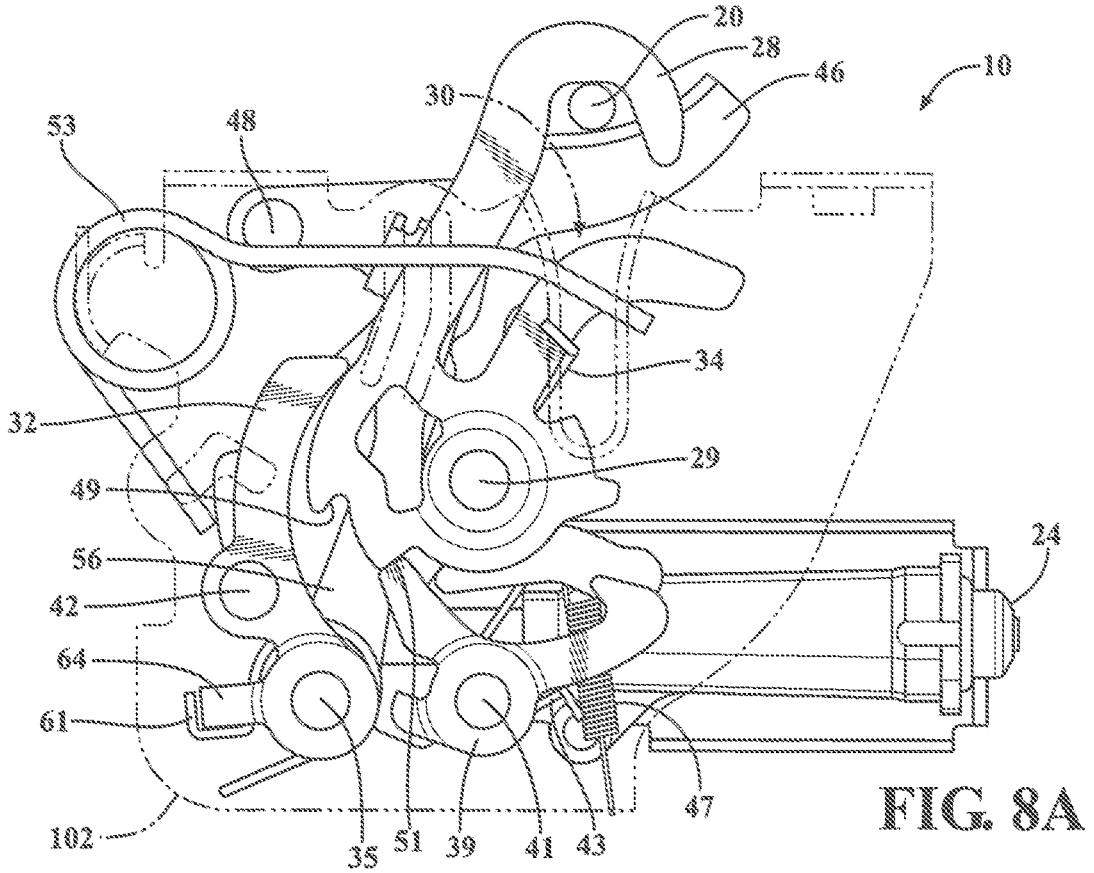

In FIG. 8, wherein the plunger 36 is shown as having been fully extended to a fully deployed state and the control lever 38 has been fully rotated in a counterclockwise direction, the primary pawl pin 42 is received in a recessed notch 54 of control lever 38, located between the driven leg 68 and the first cam surface 40, and immediately between the driven leg 68 and the barrier surface 50, of the control lever 38 under the bias of primary pawl spring 61 such that the control lever 38 is prevented from rotating back in the clockwise direction. As such, the blocking surface 52 is maintained in blocked engagement with the lift lever 46, thereby maintaining the striker 20 and the hood 14 in the partially unlatched, raised position. Meanwhile, a leg of the secondary pawl 39 is brought into locked engagement with a second locking notch or surface 51 of the ratchet 28 via bias imparted by the secondary pawl spring 43 to maintain the ratchet 28 is its striker partial release position. The ratchet 28 is illustratively provided with a hooked end 129 to maintain the striker 20 in its partial release position and prevents any further upward motion of the striker 20 which may be caused by the momentum imparted on the striker 20 by the deployment of the lift lever 46, to ensure the hood 14 is not excessively moved to a position above the engine 26.

Therefore, a three stage control lever 38 is provided which includes a first stage whereby a first rotation of the control lever 38 acts on the primary pawl 32 to move or pivot the primary pawl 32 out of locked engagement from the ratchet 28, a second stage whereby a continued second rotation of the control lever 38 acts on the lift lever 46 to move the lift lever 46 from a non-deployed position to a deployed position while maintaining the primary pawl 32 out of locked engagement from the ratchet 28, and a third stage whereby a continued third rotation of the control lever 38 acts on the lift lever 46 to maintain the lift lever 46 in a deployed position. It is recognized that there may be some overlap between the control stages of the control lever 38 and its influence on the various components described.

Figure 9:
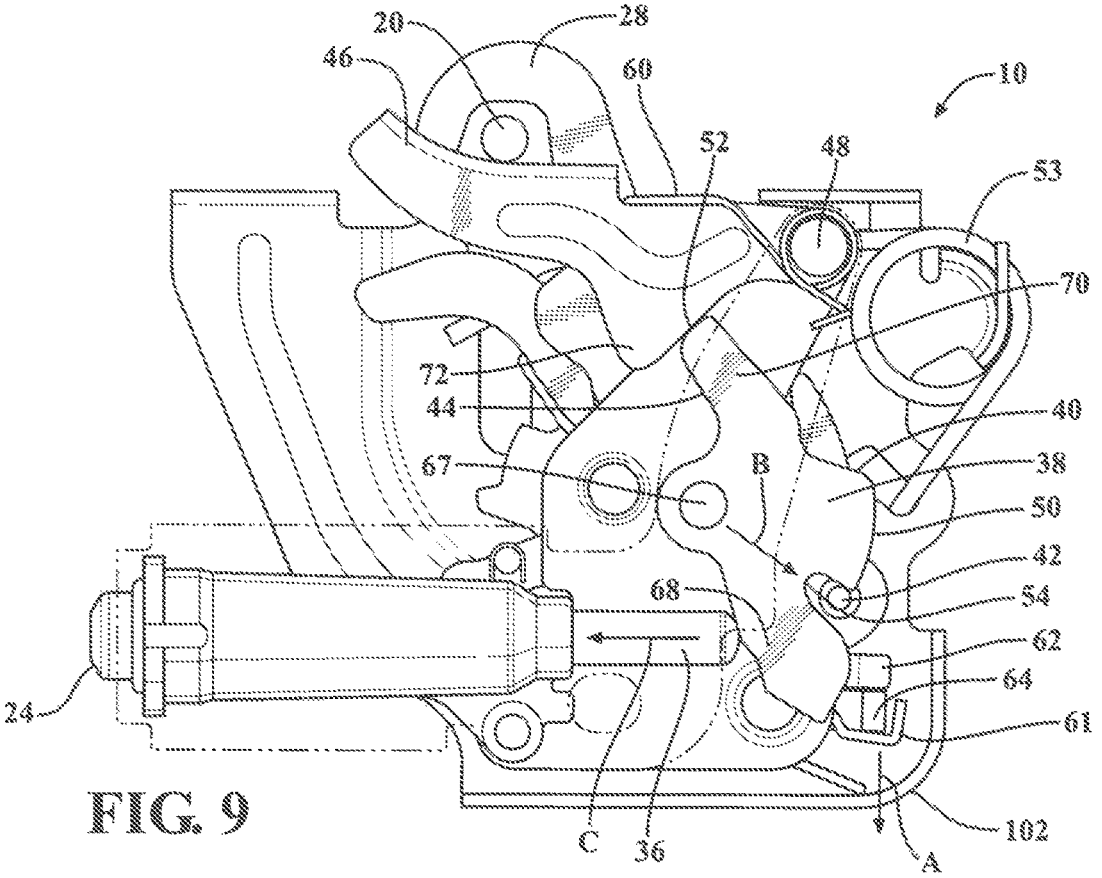
FIGS. 9 and 9A are similar views of the latch assembly as shown in FIGS. 8 and 8A, showing directional movement of latch components to allow the vehicle hood to be selectively returned to the fully closed and fully latched state.
Figure 9A:
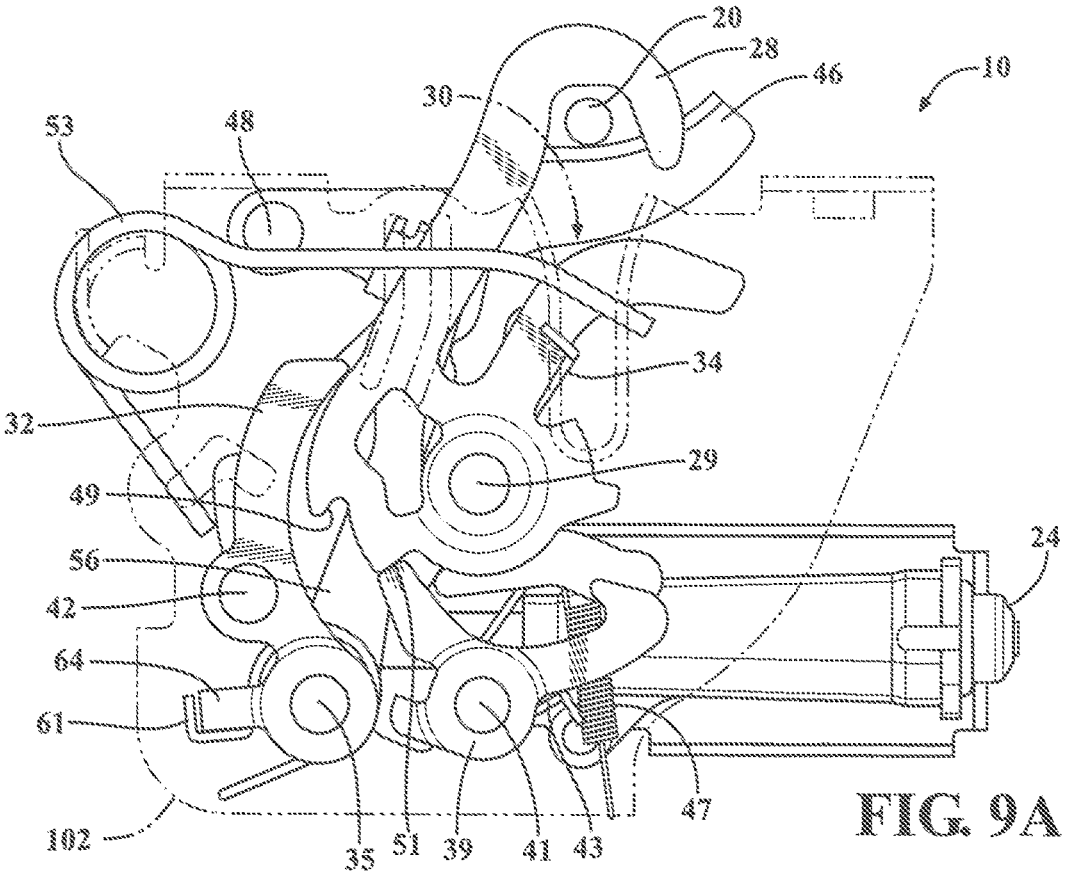

In FIG. 9, when desired, the lift lever 46 can be selectively disengaged, whereupon the striker 20 and hood 14 can be returned to a fully latched, striker capture position, thereby allowing the vehicle 11 to be transported or driven without fear of the hood 14 inadvertently opening. To disengage the lift lever 46, the release lever 56 can be actuated, such as via the hood release member/cable 19 attached to a hood latch release handle 74, by way of example and without limitation, in the passenger cabin of the vehicle 11. As the release lever 56 is pivoted via release member 19 as indicated by arrow R (see FIG. 3), an arm 62, extending laterally outwardly from a generally planar body of release lever 56, is driven in the direction of arrow A and brought into engagement with a tab 64 extending outwardly from the generally planar body of primary pawl 32 and causes the primary pawl 32 to be rotated clockwise, such that the pawl pin 42 is pivotably moved in the direction of arrow B out of the recessed notch 54. As such, with the plunger 36 being free for axial return movement in the direction of arrow C, the control lever 38 is no longer locked against return movement in the clockwise direction. The weight of the hood 14 acting on the control lever 38 via the striker 20, and/or a downward urging on the hood 14 by a user, causes the control lever 38 to rotate clockwise and in doing so permits the striker 20 to descend into the fishmouth 30. During the descent of the striker 20 into the fishmouth 30, the striker 20 imparts a rotation of the ratchet 28 towards the striker capture position whereat the a nose of the primary pawl 32 is maintained in the closed, ratchet checking position in locked engagement with the primary locking notch or surface 49 of the ratchet 28 via bias imparted by the primary pawl spring 61. Further yet, a spring force applied by a release lever spring 60 can return the lift lever 46 in a counterclockwise direction to its home position. As such, a closing force can be applied to the hood 14, such as via weight of the hood 14 or via an externally applied force to the hood 14 by a passenger, thus bringing the hood 14 to the fully closed and locked position.

The foregoing description of the embodiments has been provided for purposes of illustration and description. It is not intended to be exhaustive or to limit the disclosure. Individual elements, assemblies/subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hood latch for capturing and releasing a striker of a hood of a motor vehicle, comprising:

a ratchet and at least one pawl, the ratchet being moveable between a striker capture position whereat the ratchet retains the striker in a fully closed position, a striker partial release position whereat the ratchet retains the striker in a partially opened position, and a striker release position whereat the ratchet releases the striker, the at least one pawl being moveable between a primary lock position whereat the at least one pawl holds the ratchet in the striker capture position, a secondary lock position whereat the at least one pawl holds the ratchet in the striker partial release position, and an open position whereat the at least one pawl allows the ratchet to move to the striker release position;

a lift lever configured to pivot from a home position to a deployed position in forcible engagement with the striker;

a control lever configured to move from a home position to a deployed position and having a first cam surface and a second cam surface; and an actuator configured for communication with a sensor and being actuatable in response to a signal from the sensor, said actuator being configured to move into engagement with said control lever upon actuation of the actuator to move said control lever and bring said first cam surface into engagement with said at least one pawl to pivot said at least one pawl out of locked engagement with said ratchet, whereupon said second cam surface is moved into engagement with said lift lever to pivot said lift lever from its home position to its deployed position and into forcible engagement with the striker to move and support the hood in a partially open state, wherein the control lever is configured to be releasably maintained in its deployed position to prevent the lift lever from returning to its home position, thereby preventing the hood from being closed.

2. The hood latch of claim 1, wherein said at least one pawl has a generally planar body and a pawl pin extending outwardly from said generally planar body and said control lever has a recessed notch configured for receipt of said pawl pin to releasably maintain the control lever in its deployed position.

3. The hood latch of claim 2, further including a release lever configured to selectively pivot said pawl and move said pawl pin out of said recessed notch to allow said control lever to return to its home position and said lift lever to return to its home position and to allow said hood to be closed.

4. The hood latch of claim 3, wherein said release lever is manually actuatable from within a cabin of the vehicle.

5. The hood latch of claim 3, wherein said lift lever is biased toward its home position by a spring.

6. The hood latch of claim 1, wherein said actuator is a pyrotechnic actuator.

7. The hood latch of claim 2, wherein said actuator has a plunger and said control lever has a pivot axis about which said control lever pivots between its home position and deployed position, with a driven leg extending away from said pivot axis for engagement with said plunger and a drive leg extending away from said pivot axis for engagement with said lift lever, said driven leg and said drive leg extending from opposite sides of said pivot axis away from one another.

8. The hood latch of claim 7, wherein said first cam surface and said second cam surface are on opposite sides of said drive leg with a blocking surface extending along a free end of said drive leg, said blocking surface being configured for abutment with said lift lever while said control lever is in its deployed position.

9. The hood latch of claim 8, wherein said recessed notch is between said driven leg and said first cam surface.

10. The hood latch of claim 2, wherein said at least one pawl includes a primary pawl configured to releasably maintain said ratchet in its striker capture position and a secondary pawl configured to releasably maintain said ratchet in its striker partial release position, wherein said pawl pin extends from said primary pawl.

11. A hood latch system for capturing and releasing a striker of a hood of a motor vehicle, comprising:

a latch assembly having a ratchet and at least one pawl, the ratchet being moveable between a striker capture position whereat the ratchet retains the striker in a fully closed position, a striker partial release position whereat the ratchet retains the striker in a partially opened position, and a striker release position whereat the ratchet releases the striker, the at least one pawl being moveable between a primary lock position whereat the at least one pawl holds the ratchet in the striker capture position, a secondary lock position whereat the at least one pawl holds the ratchet in the striker partial release position, and an open position whereat the at least one pawl allows the ratchet to move to the striker release position;

a lift lever configured to pivot from a home position to a deployed position in forcible engagement with the striker;

a control lever configured to move from a home position to a deployed position and having a first cam surface and a second cam surface;

a controller;

a sensor configured in electrical communication with said controller; and an actuator configured in electrical communication with said controller, said actuator being actuatable in response to a signal communicated from said sensor to said controller and from said controller to said actuator, said actuator being configured to move into engagement with said control lever upon actuation of the actuator to move said control lever and bring said first cam surface into engagement with said at least one pawl to pivot said at least one pawl out of locked engagement with said ratchet, whereupon said second cam surface is moved into engagement with said lift lever to pivot said lift lever from its home position to its deployed position and into forcible engagement with the striker to move and support the hood in a partially open state, wherein the control lever is configured to be releasably maintained in its deployed position to prevent the lift lever from returning to its home position, thereby preventing the hood from being closed.

12. The hood latch system of claim 11, wherein said at least one pawl has a generally planar body and a pawl pin extending outwardly from said generally planar body and said control lever has a recessed notch configured for receipt of said pawl pin to releasably maintain the control lever in its deployed position.

13. The hood latch system of claim 12, further including a release lever configured to selectively pivot said pawl and move said pawl pin out of said recessed notch to allow said control lever to return to its home position and said lift lever to return to its home position and to allow said hood to be closed.

14. The hood latch system of claim 13, wherein said release lever is manually actuatable from within a cabin of the vehicle.

15. The hood latch system of claim 13, wherein said lift lever is biased toward its home position by a spring.

16. The hood latch system of claim 11, wherein said actuator is a pyrotechnic actuator.

17. The hood latch system of claim 12, wherein said actuator has a plunger and said control lever has a pivot axis about which said control lever pivots between its home position and deployed position, with a driven leg extending away from said pivot axis for engagement with said plunger and a drive leg extending away from said pivot axis for engagement with said lift lever, said driven leg and said drive leg extending from opposite sides of said pivot axis away from one another.

18. The hood latch system of claim 17, wherein said first cam surface and said second cam surface are an opposite sides of said drive leg with a blocking surface extending along a free end of said drive leg, said blocking surface being configured for abutment with said lift lever while said control lever is in its deployed position.

19. The hood latch system of claim 18, wherein said recessed notch is between said driven leg and said first cam surface.

20. The hood latch system of claim 12, wherein said at least one pawl includes a primary pawl configured to releasably maintain said ratchet in its striker capture position and a secondary pawl configured to releasably maintain said ratchet in its striker partial release position, wherein said pawl pin extends from said primary pawl.

* * * * *